US005152512A

United States Patent [19]

Yoshida et al.

[11] Patent Number: 5,152,512

[45] Date of Patent: Oct. 6, 1992

[54] SHEET RECEIVING APPARATUS, SHEET DELIVERY APPARATUS AND AUTOMATIC TRANSACTION APPARATUS HAVING AN EXTENSIBLE SHEET TRANSFER PATH

[75] Inventors: Kazushi Yoshida, Ibaraki; Masataka Kawauchi, Ishioka; Haruo Yamanaka, Seto, all of Japan

[73] Assignee: Hitachi, Ltd., Tokyo, Japan

[21] Appl. No.: 466,634

[22] Filed: Jan. 17, 1990

[30] Foreign Application Priority Data

Jan. 20, 1989 [JP] Japan ..... 1-009756

[51] Int. Cl.[5] ..... B65H 5/22

[52] U.S. Cl. ..... 271/3.1; 271/272; 271/277; 271/162; 271/200; 271/213; 414/789.7; 414/794.4; 902/33; 902/34; 235/379

[58] Field of Search ..... 271/3, 3.1, 6, 7, 213, 271/198, 200, 273, 274, 306, 14, 11, 162-164, 272, 277, 275; 414/789.7, 794.4, 790.9; 235/379; 902/14, 17, 33, 34

[56] References Cited

U.S. PATENT DOCUMENTS

| | | | |
|---|---|---|---|
| 2,896,946 | 7/1959 | Barratt et al. | 271/6 |
| 4,084,149 | 4/1978 | Driver et al. | 902/33 X |
| 4,177,982 | 12/1979 | Bewersdorf et al. | 271/6 X |
| 4,516,015 | 5/1985 | Uchida et al. | 235/379 |
| 4,579,446 | 4/1986 | Fujino et al. | 271/185 X |
| 4,662,621 | 5/1987 | Lundblad | 271/3 |
| 4,699,272 | 10/1987 | Kokubo et al. | 271/306 X |
| 4,711,444 | 12/1987 | Geurts | 271/200 X |
| 4,728,090 | 3/1988 | Oota et al. | 271/7 |
| 4,735,289 | 4/1988 | Kenyon | 902/33 X |
| 4,736,852 | 4/1988 | Edin et al. | 414/790.9 X |
| 4,775,783 | 10/1988 | Sasaki et al. | 235/379 |
| 4,820,909 | 4/1989 | Kawauchi et al. | 235/379 |
| 4,866,254 | 9/1989 | Okayama et al. | 271/9 X |

FOREIGN PATENT DOCUMENTS

| | | | |
|---|---|---|---|
| 89142 | 7/1980 | Japan | 271/6 |
| 154538 | 6/1988 | Japan | 271/3.1 |
| 313258 | 12/1989 | Japan | 271/9 |
| 241171 | 11/9185 | Japan | 235/379 |
| 2071059 | 9/1981 | United Kingdom | 271/7 |

*Primary Examiner*—Robert P. Olszewski
*Assistant Examiner*—Boris Milef
*Attorney, Agent, or Firm*—Antonelli, Terry, Stout & Kraus

[57] ABSTRACT

A sheet dealing apparatus feeds sheets, received within the apparatus, to a user through a sheet delivery portion by an operation of the user or receives the sheets into the sheet dealing apparatus from the user. Also, this operation may be similarly applied to the sheet delivery mode between the sheet dealing apparatus and another sheet dealing apparatus. The sheet delivery portion is contructed so as to be retractable or extensible with respect to a body of the apparatus. A sheet delivery window formed at the delivery portion is variable in position as necessary.

5 Claims, 8 Drawing Sheets

SHEET RECEIVING APPARATUS, SHEET DELIVERY APPARATUS AND AUTOMATIC TRANSACTION APPARATUS HAVING AN EXTENSIBLE SHEET TRANSFER PATH

BACKGROUND OF THE INVENTION

1. Field of the Invention

The present invention relates to an apparatus for receiving and delivering sheets between one sheet dealing apparatus and another sheet dealing apparatus. In particular, the invention relates to terminal units of a bank such as an automatic transaction apparatus and a movable bill receiving apparatus, and an automatic transaction system in a bank.

2. Description of the Prior Art

In a conventional sheet receiving apparatus, as shown in, for example, Japanese Patent Unexamined Publication No. 59-33590, sheets are gripped by a gripper of an arm portion in a feeding portion, and the gripped sheets are received in a receiving portion by a transport means, thus automatically receiving the sheet in a batch manner. Also, as shown in Japanese Patent Unexamined Publication No. 59-208685, there is an automatic transaction apparatus in which a manipulator is used for delivering medium to be processed such as cash.

The above-described conventional sheet receiving apparatuses is of the batch receiving type using a kind of a manipulator. However, the conventional technique suffers from the following problems. Namely, first, since the manipulator is used for a simple operation such as delivering the sheets and receiving the sheets, the apparatus becomes large. Second, in the case where valuable sheets such as bills should be dealt with, it is necessary to confirm the number of the bills and the values thereof for every operation. Accordingly, in this case, a feeding system for delivering the sheets one by one is more effective than the batch system for feeding the sheets in a batch manner.

The above-described automatic transaction apparatus also suffers from exactly the same problems. Also, it should be noted that a manipulator fails to deliver a lot of sheets at once.

SUMMARY OF THE INVENTION

An object of the invention is to provide a movable sheet receiving apparatus that may feed and receive sheets with a simple structure and with a high reliability.

Another object of the invention is to provide an automatic transaction apparatus which is highly reliable in operation.

Still another object of the invention is to provide a sheet delivery apparatus that may change a length of its delivery path as desired.

The sheet receiving apparatuses according to the invention are classified by a portion of delivery path for feeding and receiving the sheets in cooperation with another sheet dealing apparatus, into one type in which the delivery portion has an extensible/retractable delivery path and the other type in which a delivery module automatically detachable from a body of the sheet receiving apparatus is used as the delivery portion. Also, in the case where the valuable sheets such as bills should be dealt with, since the system needs a high reliability, a discriminating portion is added to the sheet receiving apparatus.

Further, an automatic transaction apparatus of the invention comprises a bill transfer apparatus which includes the above-described extensible/retractable delivery path or the automatic detachable delivery module and a discriminating portion.

Also, according to the invention, in order to attain the foregoing and other objects of the invention, there is provided a sheet transfer apparatus comprising delivery belts extended between rotatable pulleys, a plurality of driven rollers disposed in contact with and in confronted relation with the delivery belts and rotated by the movement of the delivery belts, and guide members provided between the driven rollers for guiding sheets transfered by the delivery belts at a delivery portion, wherein a sheet delivery path is formed by the delivery belts, the driven rollers, and the guide members, delivery belt length adjusting means for adjusting a length of a horizontal portion of the delivery belts by drawing and returning the delivery belts, and the guide members include a collapsible structure that is extensible and retractable in cooperation with the delivery belt length adjusting means.

The sheet receiving apparatus according to the invention is of the movable type for example and may be used to deliver the sheets such as bills from one sheet dealing apparatus within a safe, to another sheet dealing apparatus such as a cash automatic dealing unit. In the case where the sheets received in the sheet dealing apparatus are fed out to the movable sheet receiving apparatus or where the sheets are received from the sheet dealing apparatus to the movable sheet receiving apparatus, the extensible sheet delivery portion is extended to be inserted into a delivery port of the sheet dealing apparatus when the movable sheet receiving apparatus is positioned at a predetermined position. Thus, the sheet dealing apparatus and the movable sheet receiving apparatus are connected together, to thereby form a single sheet dealing system. Therefore, the sheets within the sheet dealing apparatus may be delivered to the movable sheet receiving apparatus without using any manipulator or the like. Also, the reverse operation may be similarly attained. The delivery path of the delivery portion may be a delivery path module which is automatic detachable to the apparatus. In this case, when the movable sheet receiving apparatus reaches a predetermined position, the delivery path module is inserted into a delivery port of the sheet dealing apparatus.

Furthermore, in order to enhance the reliability of the sheet receiving apparatus, a discriminating portion is provided in the movable sheet receiving apparatus. With such an arrangement, when the bills are fed or received between the movable sheet receiving apparatus and another bill dealing apparatus, it is possible to confirm whether the exact feeding/receiving of the bills is performed. In addition, it is possible to facilitate to know the total amount of the bills received in the movable bill receiving apparatus.

Furthermore, if the above-described bill receiving apparatus is used, it is possible to provide an automatic transaction system with high reliability.

Further, if the delivery belts are drawn or returned by delivery belt length adjusting means, it is possible to vary the length of a horizontal portion of the delivery belts. In this case, the guide members having collapsible structure are opened or closed in cooperation with the delivery belt length adjusting means. As a result, when the driven rollers at both ends of the guide member are moved along the delivery belts and the length of the horizontal portion of the delivery belts is changed, the sheet may be delivered while being clamped by the driven rollers and the delivery belts without fail.

Also, if the guide member is structured by an extensible material, it is possible to ensure the foregoing effect without making the guide member collapsible.

Furthermore, without using the guide member or the driven rollers, the same effect as described above may be insured by providing a pair of delivery belts whose horizontal portions are confronted in contact with each other and drawing or returning the pair of delivery belts by the delivery belt length adjusting means.

DESCRIPTION OF THE PREFERRED EMBODIMENTS

The present invention will now be described with reference to FIGS. 1 to 4.

Figure 1:
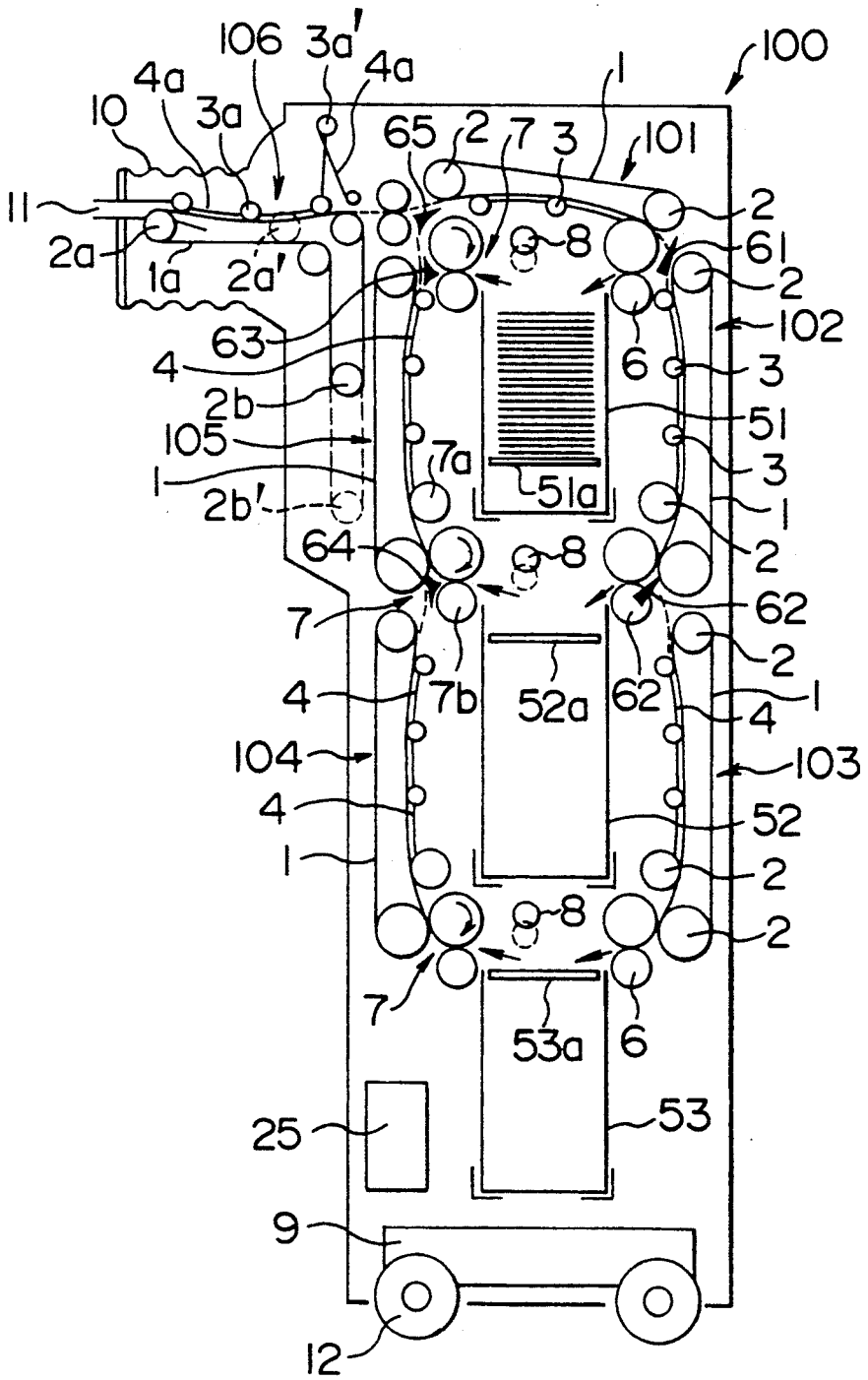
FIG. 1 is a structural view showing a sheet receiving apparatus according to an embodiment of the invention.

FIG. 1 shows a movable sheet receiving apparatus according to an embodiment of the invention. Within a box 100 of the sheet receiving apparatus, there are arranged delivery belts 1, 1*a* for delivering sheets, a plurality of pulleys 2, 2*a* for engagement with the delivery belts 1, 1*a*, a plurality of driven rollers 3, 3*a* disposed in contact with and in confronted relation with the delivery belts 1, 1*a*, and guides 4, 4*a* disposed in confronted relation with the delivery belts 1, 1*a* for insuring the stable delivery of the sheets. These components are arranged to define a first delivery path 101, a second delivery path 102, a third delivery path 103, a fourth delivery path 104, a fifth delivery path 105 and a sixth delivery path 106. Sheet receiving boxes (three boxes 51, 52 and 53 in the case of this embodiment) which may be slidingly drawn are arranged in the box 100. For these receiving boxes 51, 52 and 53, there are provided receiving mechanism 6 such as rollers for receiving the sheets into the respective boxes 51, 52 and 53, separating mechanism 7 for separating the sheets one by one, and feeding out mechanism 8 for feeding out the sheets for separation. Further, a first gate mechanism 61, a second gate mechanism 62, a third gate mechanism 63, a fourth gate mechanism 64 and a fifth gate mechanism 65 for switching the delivery direction of the sheets are provided. An extensible member 10 such as a bellows is mounted on the box 100. A delivery port 11 at which sheets are received and delivered is formed in the extensible member 10. Also, the above-described delivery path 106 is provided in connection with the delivery port 11. The above-described receiving mechanisms 6 are used for receiving new sheets one by one on the sheets stacked within the receiving boxes. In accordance with the receiving operation, bottom plates 51*a*, 52*a* and 53*a* of the receiving boxes 51, 52 and 53 are moved downwardly to keep the stacking position of the sheets, namely, the position of the top sheet.

The above-described feeding out mechanism 8 includes pressing means (not shown) for applying a pressing force necessary for separation of the sheets and a feeding out roller 8 for feeding out the stacked sheets, and the separating mechanism 7 includes separating rollers 7, 7*a* for separating the top sheet and the second sheet thereunder. On account of these mechanisms 7 and 8, the sheets are fed out and in accordance with the sheet feeding out operation, the bottom plates 51*a*, 52*a*, 53*a* of the receiving boxes 51, 52, 53 are moved upwardly.

The gate mechanisms 61, 62, 63, 64 and 65 are operated as follows. When the sheets are received in the first receiving box 51, the sheets are fed along the sixth delivery path 106 and the first delivery path 101 and to the first receiving box 51 by the first gate mechanism 61. When the sheets are fed out from the first receiving box 51, the sheets are fed along the sixth delivery path 106 to the delivery port 11 by the fifth gate mechanism 65. When the sheets are received in the second receiving box 52, the sheets are fed along the sixth delivery path 106, the first delivery path 101 and the second delivery path 102 to the second receiving box 52 by the second gate mechanism 62. When the sheets are fed from the second receiving box 52, the sheets are fed along the fifth delivery path 105 to the sixth delivery path 106 and the delivery port 11 by the fifth gate mechanism 65. Further, when the sheets are received in the third receiving box 53, the sheets are fed along the sixth delivery path 106, the first delivery path 101, the second delivery path 102 and the third delivery path 103. Also, when the sheets are fed out from the third receiving box 53, the sheets are fed from the third receiving box 53 along the fourth delivery path 104, the fifth delivery path 105 and the sixth delivery path 106.

In this embodiment, a moving mechanism 12 is provided for moving a whole of the apparatus.

This moving mechanism 12 for moving the whole apparatus is driven by a drive mechanism 9. Also, the above-described mechanisms are drivingly controlled by a controller 25. This movable sheet receiving apparatus is used to receive the sheets from one sheet dealing apparatus, temporarily receiving in the receiving boxes within the box 100 and moving to another sheet dealing apparatus to feeding the sheets. In this delivering operation, the pulleys 2*a* and 2*b* engaged with the delivery belt 1*a* at a delivery portion is moved from the original positions indicated in dotted lines and to the positions indicated in solid lines in FIG. 1. In accordance with this movement, the guides 4*a* and the extensible member 10 are extended so that the delivery port 11 is inserted into a delivery port of another associated sheet dealing apparatus.

Figure 2:
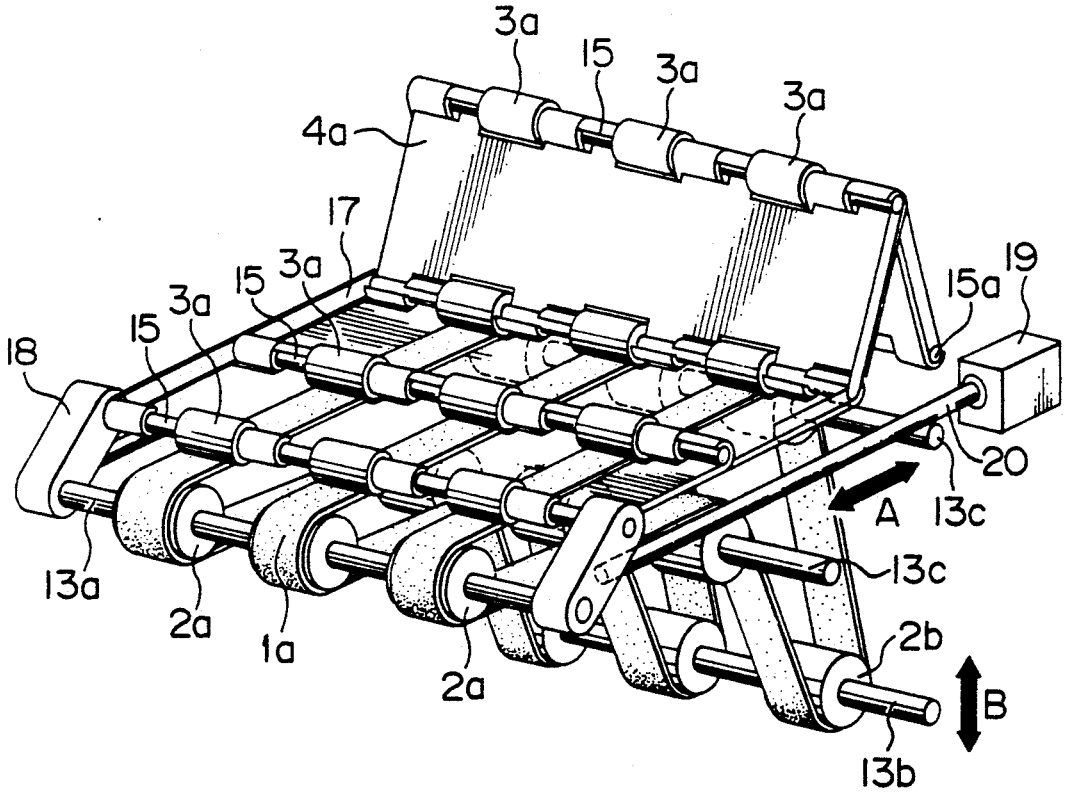
FIG. 2 is a perspective view showing in more detail a delivery portion of the sheet receiving apparatus shown in FIG. 1.

An example of the delivery portion mechanism is shown in FIG. 2. The delivery portion mechanism includes delivery belts 1*a*, pulleys 2*a*, driven rollers 3*a*, guides 4*a*, shafts 15 for supporting the driven rollers 3*a*, a connecting linkage rod 17 for connecting these shafts 15, connecting members 18 mounted so that a shaft 13*a* for carrying the pulleys 2*a* and the shaft 15 for carrying the driven rollers 3*a* may be cooperatively moved, an actuator 19 for driving the shafts 13*a* and 15 to change a length of the path, and a telescopic arm 20 for connecting the connecting member 18 and the actuator 19. These components are drivingly controlled by drive means and controller (not shown in FIG. 2). In this embodiment, the two shafts 13*a* and 13*b* are movable whereas the other two shafts 13*c* are held in a stationary manner. With respect to the shafts for carrying the driven rollers 3*a* and the drive guides 4*a*, only the shaft 15*a* is held in a stationary manner, whereas the other shafts 15 are movable. When the length of the delivery path is determined and a command signal is issued from the controller to the actuator 19, the actuator 19 moves the telescopic arm 20 in a direction indicated by an arrow A corresponding to the assigned length. At this time, the shafts 13*a*, 15 and the bellows 10 (shown in FIG. 1) carried on the connecting members 18 mounted at a distal end of the arm 20 are moved together. Since the shafts 15 are connected to each other through the connecting linkage rods 17, the drive rollers 3*a* and the guides 4*a* are drawn as necessary, thus defining a suitable delivery path. On the other hand, due to the fact that the shaft 13*a* for carrying the pulleys 2*a* is moved, it is necessary to keep the length of the delivery belts 1*a* at the initial constant length. Accordingly, in this embodiment, the shaft 13*b* is moved in a direction indicated by an arrow B so that the effective length of the delivery belts 1*a* may be kept at a constant.

Figure 3:
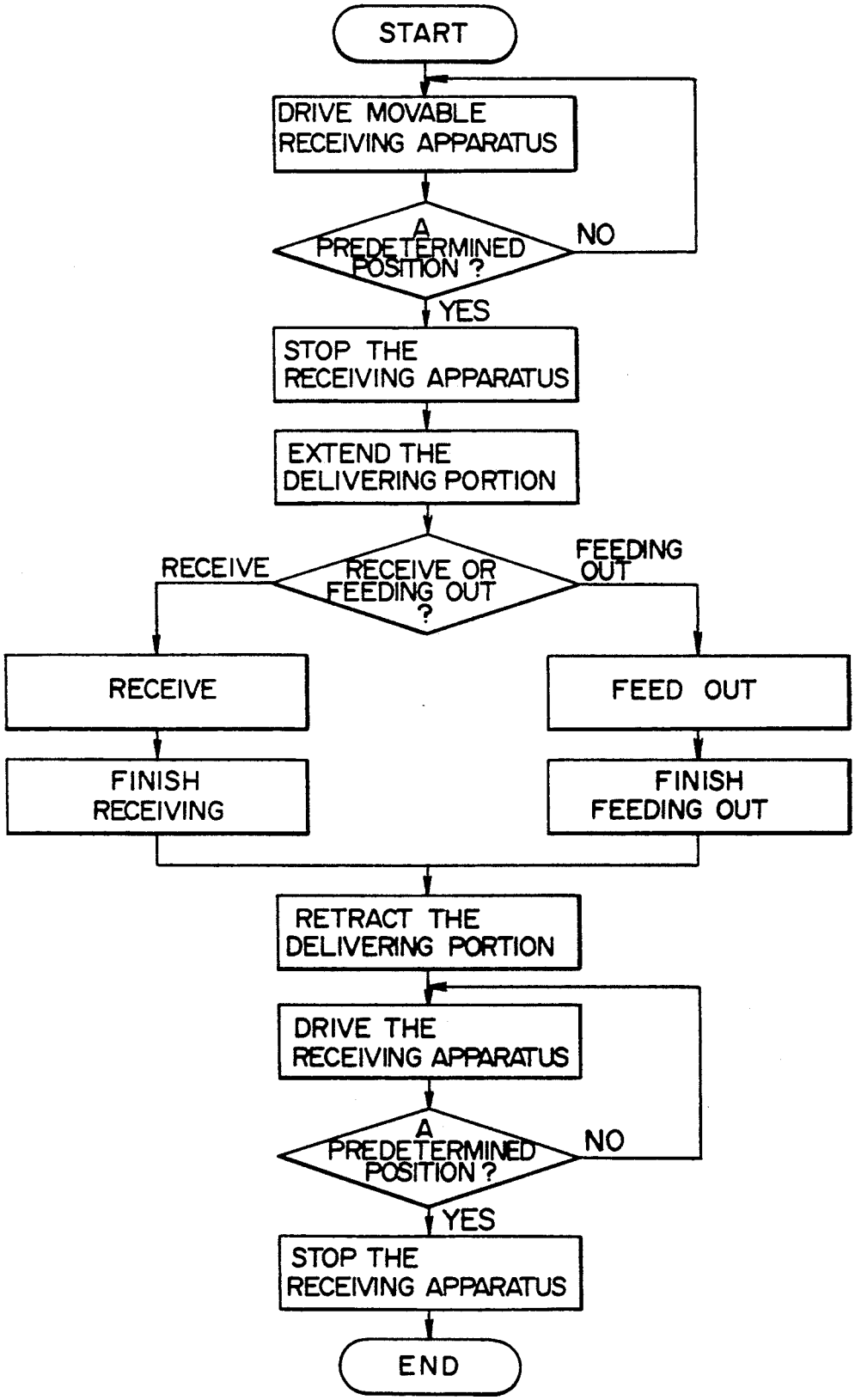
FIGS. 3, 4 and 5 are flowcharts showing a primary operation of the apparatus according to the invention.
Figure 4:
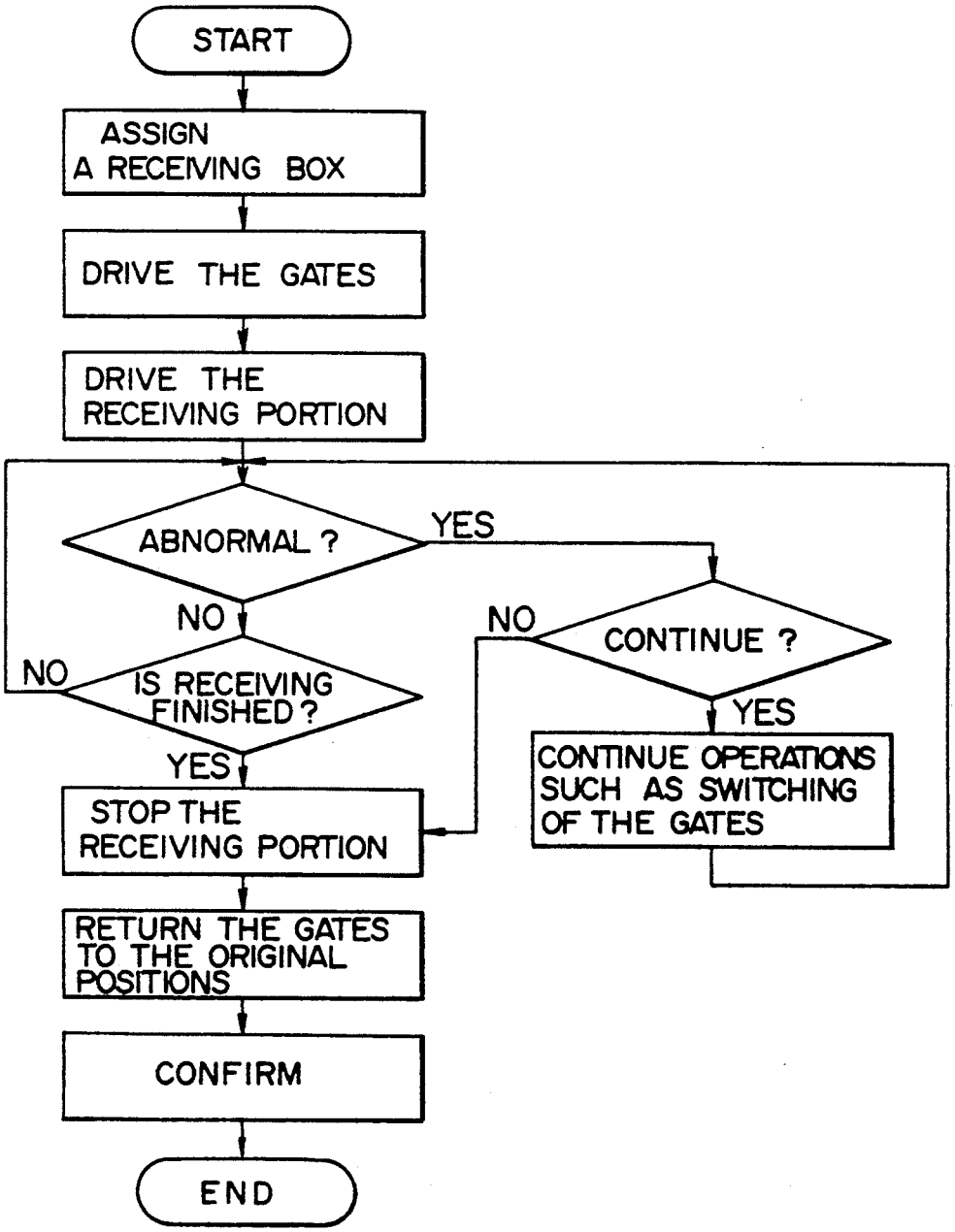
Figure 5:
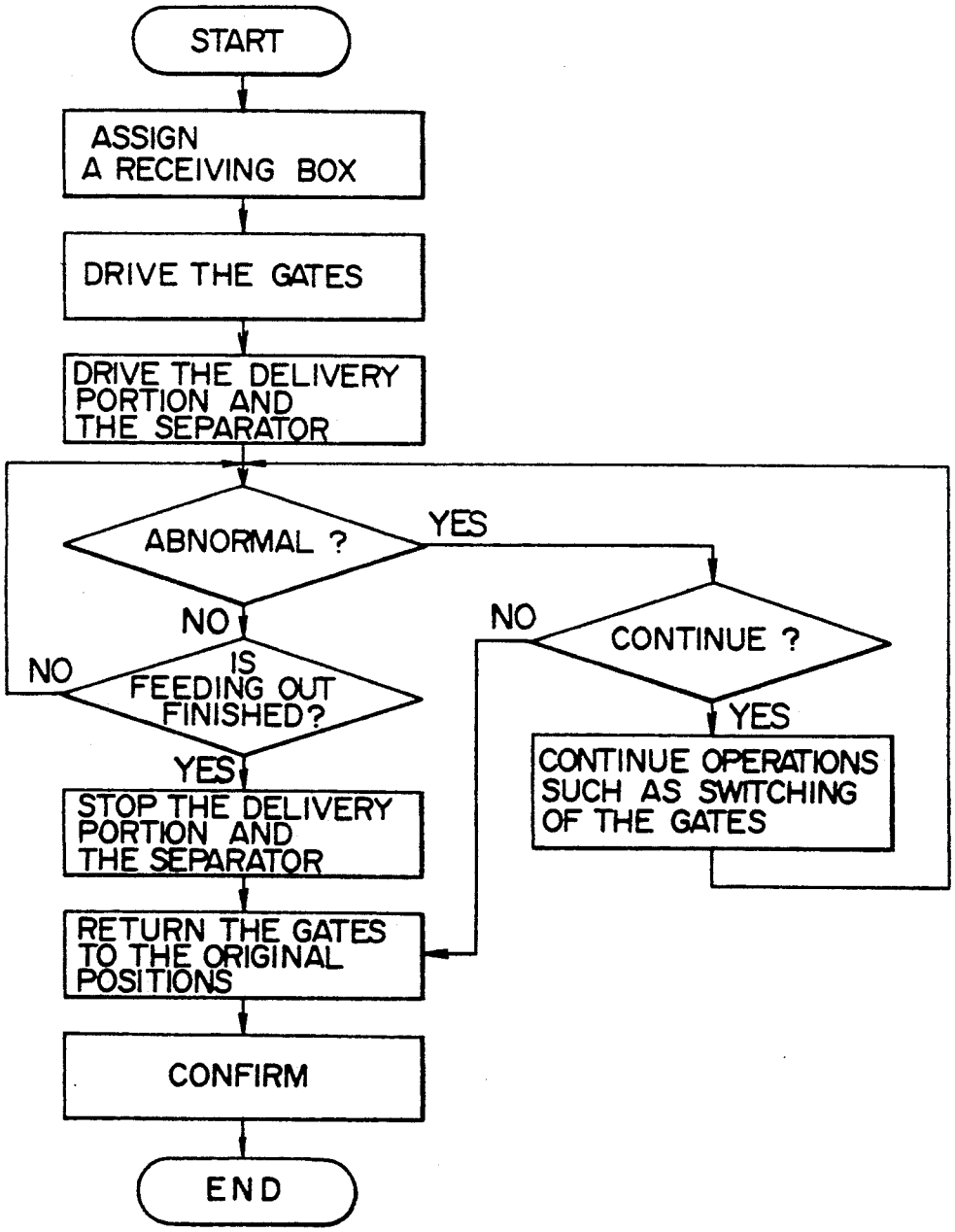

By a signal from the outside, such as another sheet dealing apparatus that deals the sheets with the present apparatus, it is determined which receiving box should be used to receive the sheets received from its delivery port or which receiving box should be used to feed out the sheets. For this reason, the respective gates are to be mainly controlled on the basis of the signals from the outside. However, in the case where the receiving boxes are filled with the sheets, it is possible to perform the above-described judgement and control in accordance with a signal from a sensor provided within the present apparatus. FIGS. 3, 4 and 5 are flowcharts showing the main operation of the present apparatus. In particular, FIG. 3 is a flowchart showing the overall operation of movement, sheet dealing and receiving the sheets in the present apparatus. FIG. 4 shows the receiving operation and FIG. 5 shows the feeding out operation. In the present apparatus, when the sheets are received therein, the sheets are stacked one by one on the sheets stacked in the receiving box, whereas, when the sheets are fed out, the sheets are fed out by the frictional force of the feeding rollers 8 and are separated one by one by the separators 7*a*, 7*b*.

According to the foregoing embodiment, it is unnecessary to deliver a block or stack of sheets for the feeding and receiving operation of the sheets, and it is possible to perform the sheet receiving and feeding operation smoothly with ease.

Figure 6:
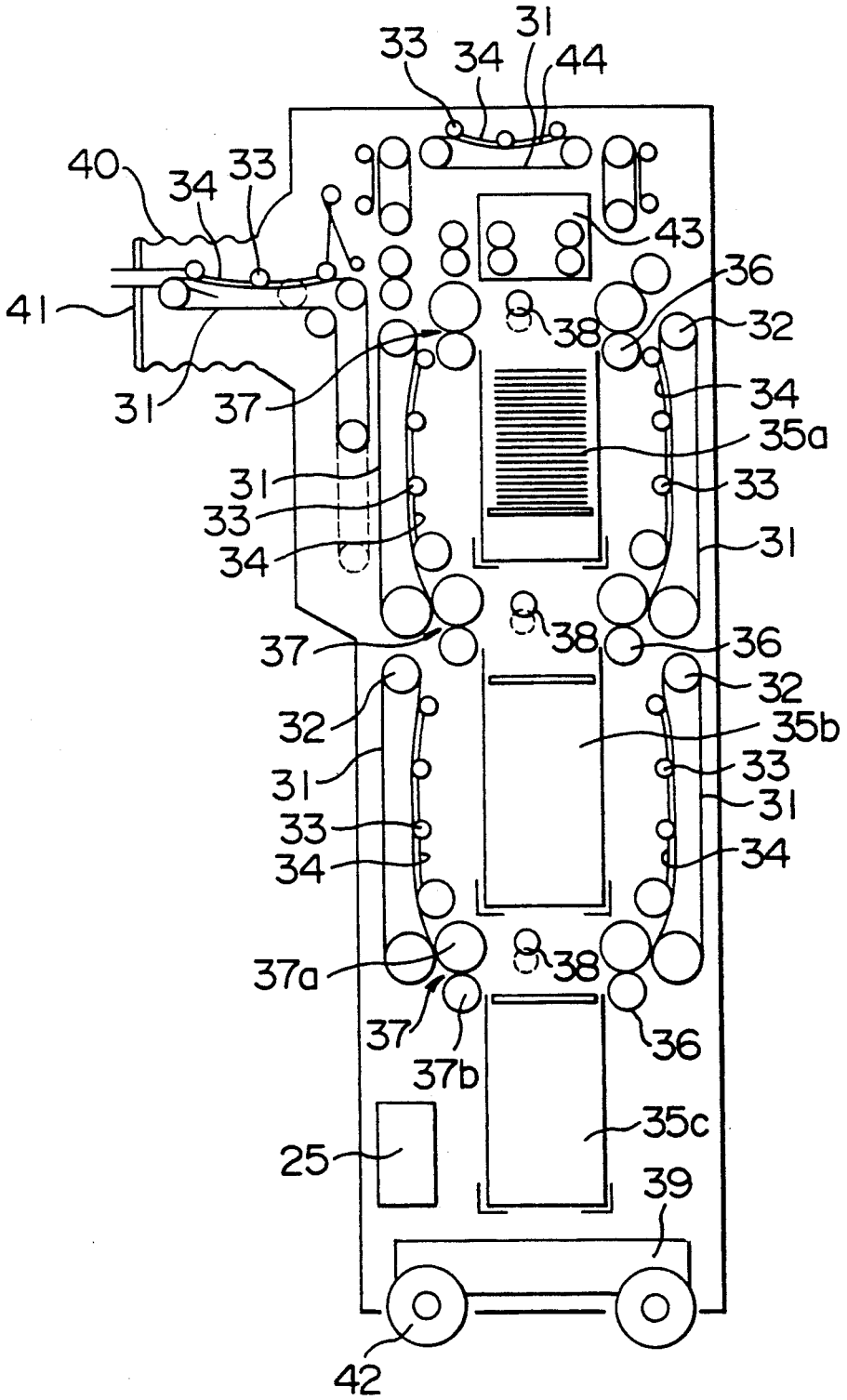
FIG. 6 is a structural view showing a sheet receiving apparatus according to another embodiment of the invention.

FIG. 6 shows another embodiment of the sheet receiving apparatus which is applied to a bill receiving apparatus. The bill receiving apparatus includes delivery belts 31 for feeding the bills, pulleys 32 for engagement with the delivery belts 31, a plurality of driven rollers 33 disposed in contact with and in confronted relation with the delivery belts 31, and guides 34 mounted for stable delivery of the bills when the bills are delivered. A plurality of delivery paths are defined by the delivery belts, driven rollers and guides. Also, the apparatus includes a plurality (three in this case) of receiving boxes 35*a*, 35*b* and 35*c* for receiving bills, receiving mechanisms 36 such as rollers for receiving the bills, separating mechanism 37 for separating the received bills one by one, feeding out mechanisms 38 for feeding out the bills for separation, gate mechanisms (not shown) for switching the delivery direction of the bills, a drive mechanism 39 for driving a bill transport mechanism or the entire apparatus, an extensible bellows 40, a delivery port 41 for receiving and feeding out the bills, a moving mechanism 42 for moving the overall apparatus, a discriminating portion 43 for discriminating the bills, and a controller (not shown) for controlling the apparatus.

This movable bill receiving apparatus is used for receiving bills from one bill dealing apparatus, temporarily receiving the bills, and moving to another bill receiving apparatus and feeding out the received bill to another apparatus. According to this embodiment, when the bills are received or fed out, the apparatus is operated in the same manner as shown in FIGS. 1 and 2. However, in the case where a valuable sheets such as bills are dealt with, it is absolutely necessary to confirm the value of the bill. Therefore, in the movable bill receiving apparatus according to this embodiment, the discriminating portion 43 is provided in the interior of the apparatus. Also, the receiving boxes are separated into a 10,000 yen bill receiving box 35*a*, a 1,000 yen bill receiving box 35*b*, and a temporarily receiving box 35*c*. First of all, when the bills are received, the bills that have passed through the delivery port 41 are received through the discriminating portion 43 via the respective delivery paths to the temporarily receiving box 35*c*. Then, the value of the bills is compared with the value of the bills of the associated bill dealing apparatus. If the value is correct, the bill is delivered from the temporarily receiving box 35*c* through the delivery paths to the discriminating portion 43, so that the 10,000 yen bills are received in the 10,000 yen receiving box 35*a* and the 1,000 yen bills are received in the 1,000 yen bill box 35*b*. If the value is not correct, the bills are returned from the temporarily receiving box 35*c* through the delivery paths, the discriminating portion 43 and a bill payout route 44 back to the associated bill dealing apparatus.

In the case where the bills are fed out, the 10,000 yen bills and 1,000 yen bills are separately fed out from the 10,000 yen bill receiving box 35*a* and the 1,000 yen bill receiving box 35*b*, respectively. After the passage of the discriminating portion 43, the bills are paid out through the payout route 44 and delivery port 41. According to this embodiment, the bills are received one by one into the receiving boxes. Also, the separation of the bills may be attained by a frictional type separator whose detailed explanation will be omitted herein. The feeding out rollers 38 feeds out the bills due to the friction and the separating rollers 37*a*, 37*b* separate the sheets one by one. After the payment, the value of bills is confirmed. If the value is correct, the dealing operation is finished, whereas if the value is not correct, the bills fed out are again returned to the movable bill receiving apparatus in the same manner as in the case of the bill receiving operation., and the value is again checked.

According to this embodiment, it is possible to provide a movable bill receiving apparatus that may readily perform the bill dealing without fail and with high reliability. Although the extensible delivery path shown in FIG. 2 is used at the delivery portion in both the sheet receiving apparatus shown in FIG. 1 and the bill receiving apparatus shown in FIG. 6, it is possible to use another delivery path module, that is automatically detachable, at the delivery portion.

Figure 7:
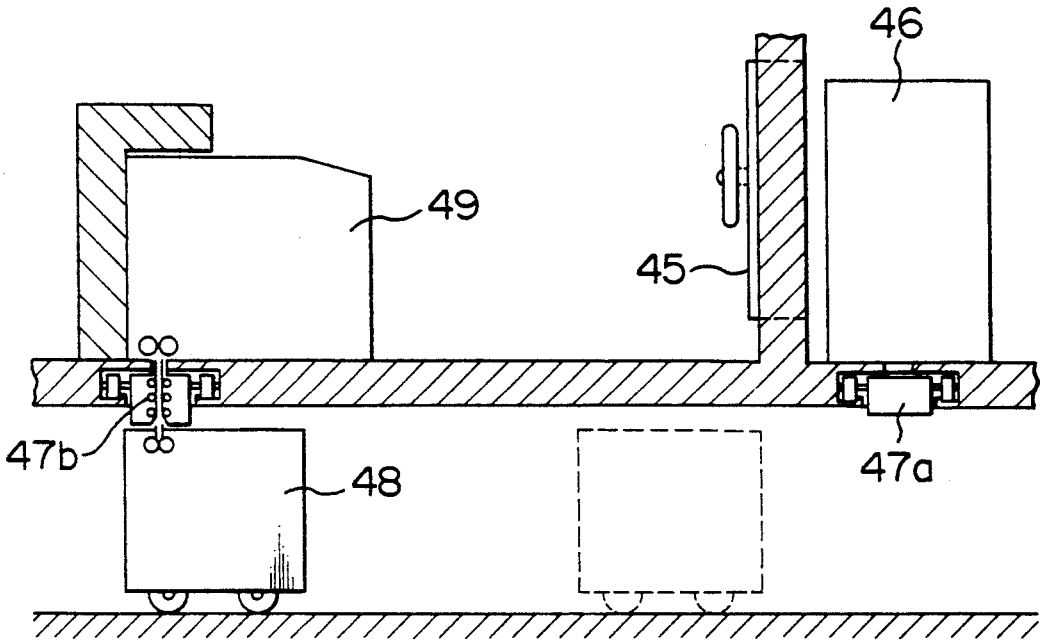
FIG. 7 is a view showing an embodiment of the invention in which automatically detachable delivery path modules are used.

FIG. 7 shows one embodiment of a movable bill receiving apparatus in which an automatically detachable delivery path module is used. The bills are delivered from a bill dealing apparatus 46 within a safe 45 to a movable bill receiving apparatus by the above-described delivery path module 47*a*. The movable bill receiving apparatus 48 is moved to a position below another bill dealing apparatus 49. The bills are fed out to the bill dealing apparatus 49 by a delivery path module 47*b*. The delivery path modules 47*a*, 47*b* are also movable to necessary positions. These modules are automatically mounted on the movable bill receiving apparatus 48 during the feeding/receiving operation. These modules are automatically removed from the apparatus. In this embodiment, although the movable bill receiving apparatus and the delivery path modules 47 are made discrete from each other, the delivery path modules 47 may be mounted on the movable bill receiving apparatus 48 or the bill dealing apparatuses 46, 49.

Figure 8:
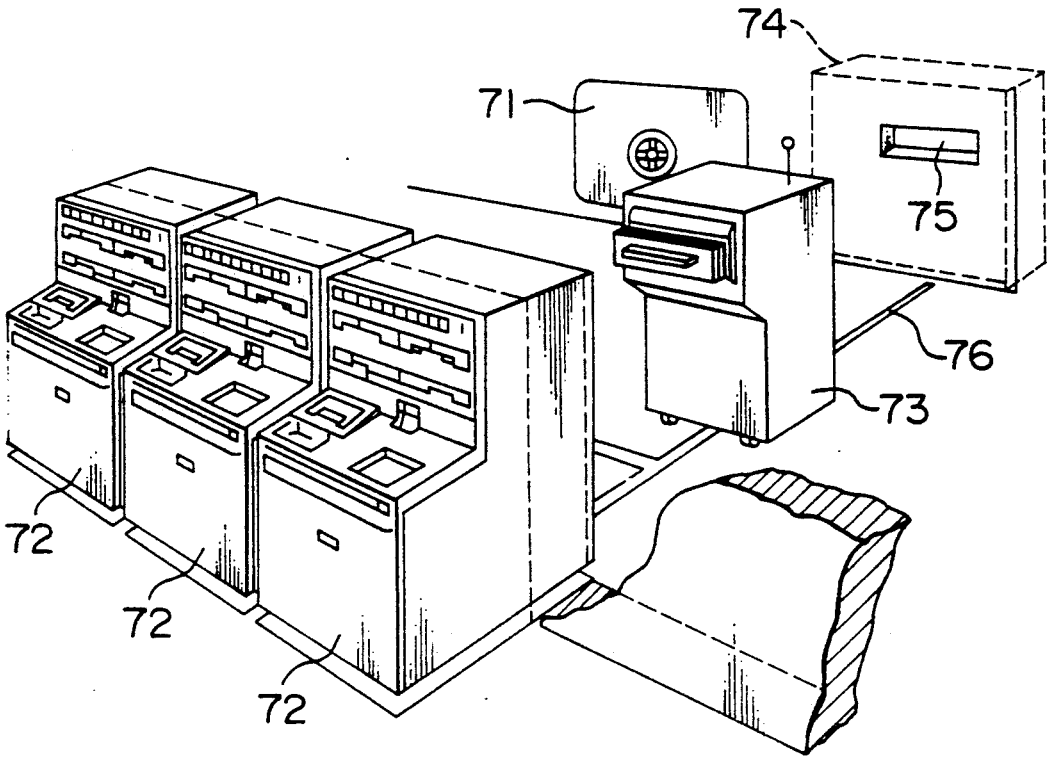
FIG. 8 is a schematic view showing an automatic transation apparatus provided with the sheet receiving apparatus according to the invention.

FIG. 8 shows one embodiment of an automatic dealing system in which the above-described movable bill receiving apparatus is used. The automatic dealing system includes a safe 71, a plurality of automatic transaction machines 72 through which customers or bank clerks may access medium to be processed such as cash, bankbooks, cash cards and the like for trading, a programmed controller (not shown), a plurality of processors 74 for processing the cash, bankbooks, cash cards and the like respectively under the control of the programmed controller, and a movable bill receiving apparatus 73 for transporting the medium to be processed such as cash, bankbooks, cash cards or the like between the automatic transaction machines 72 and the processors 74. In this embodiment, the movable bill receiving apparatus shown in FIG. 6 is used as a movable sheet receiving apparatus. The delivery of bills is performed through a delivery window 75 from the processors 74 disposed within the safe 71 to the movable bill receiving apparatus 73. The movable bill receiving apparatus 73 is moved to the automatic transaction machines 72 along a predetermined route 76. When the bill receiving apparatus 73 reaches a predetermined position, the bills are delivered to the automatic transaction machines. In the case where the bills are received from the automatic transaction machines 72 to the safe 71, the operation is reversely performed. The delivery window 75 is closed by a shutter except for the operative time. Also, in case of bill delivery accident or burglar, a sensor incorporated in the movable apparatus may detect the accident and issue a warning signal to a guarding room or the like. According to this embodiment, it is possible to provide an automatic dealing or trading system that has a high reliability.

Figure 9:
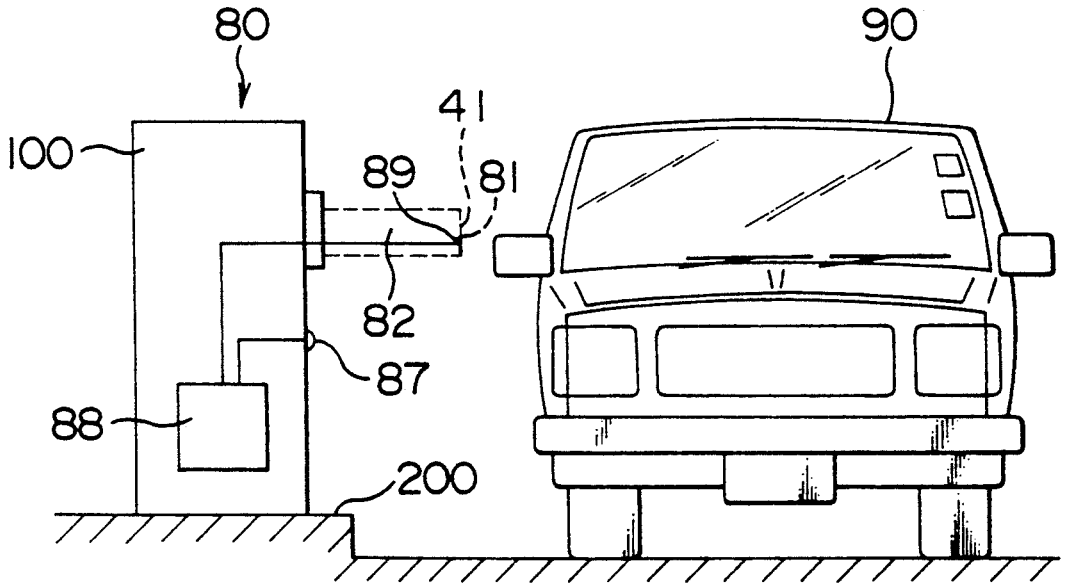
FIG. 9 is a schematic view showing a cash automatic transaction apparatus having a sheet delivering apparatus of the invention to which a driver in a car is accessible.

FIG. 9 shows a drive-through type cash dealing apparatus to which applied is the sheet receiving apparatus according to the present invention. In this automatic cash dealing apparatus 80, a box 100 is fixed on a base 200. The apparatus includes, in addition to the components shown in FIG. 1 or FIG. 6, an operation panel 81 to which the customers may access for trading, at least one distance measuring sensor 87 for measuring a distance between the apparatus 80 and the vehicle 90 when the customer's vehicle 90 accesses, a controller 88 for outputting a signal for driving the apparatus 80, and a proximity sensor 89 for preventing the cash delivery window 41 from colliding with the customers or the vehicle.

In such an automatic cash dealing apparatus, when the vehicle 90 approaches the apparatus, the distance measuring sensor 87 measures a distance between the vehicle 90 and the apparatus and issues a signal to the controller 88. When the controller 88 judges that the distance between the cash dealing apparatus 80 and the vehicle 90 is too long for the customers to safely deal with the apparatus, the cash delivery window 41 is moved, as indicated by dotted lines in FIG. 9, to a position where the dealing may safely be performed. In this case, for instance, the sheet delivery apparatus shown in FIG. 2 is incorporated within the arm 82 surrounded by the bellows. The arm 82 may extend by a length assigned by the controller 88. The proximity sensor 89 is provided for safety when the arm 82 is extended. If this sensor is turned on, the controller 88 issues a signal for stopping the movement of the arm 82.

According to the above-described cash dealing apparatus, since it is possible to automatically extend the cash delivery window 41 in correspondence with the distance between the vehicle 90 and the apparatus, it is possible to perform the safety cash delivery with ease even if the vehicle is stopped at a position somewhat far from the cash dealing apparatus 80.

As described above, according to the present invention, when the sheets are delivered, a large amount of sheets may be delivered without fail. Also, since the high reliable, automatic dealing system may be constructed by the application of the invention, it is possible to provide a new automatic trading system which does not need a lot of manual work of bank clerks.

Furthermore, it is possible to facilitate the positioning between the movable sheet receiving apparatus and the sheet dealing apparatus that performs the delivery of the sheets.

What is claimed is:

1. A sheet dealing apparatus for receiving and delivering sheets from and to other sheet dealing apparatuses comprising:

means for storing the sheets therein, means for individually feeding out and separating the sheets stacked in said storing means, means for stacking the sheets into said storing means, means for individually delivering and receiving the sheets to and from the other sheet dealing apparatuses, and means for individually transferring the sheets between said feeding and separating means, stacking means and delivering and receiving means, said transferring means including a transferring path adjacent to said delivering and receiving means, said transferring path being extensible and retractable in a sheet transferring direction thereof.

2. A sheet dealing apparatus according to claim 1, further comprising:

means for running said sheet dealing apparatus and means for drivingly controlling said running means, whereby said sheet dealing apparatus is self-propelled.

3. A bill dealing apparatus for receiving and delivering bills from and to other bill dealing apparatuses comprising:

means for storing the bills therein, means for individually feeding out and separating the bills stacked in said storing means, means for stacking the bills into said storing means, means for individually delivering and receiving the bills to and from the other bill dealing apparatuses, means for checking the value of the bills to be received and to be delivered, and means for individually transferring the bills between said feeding and separating means, stacking means, delivering and receiving means and checking means, said transferring means including a transferring path adjacent to said delivering and receiving means, said transferring path being extensible and retractable in a bill transferring direction thereof.

4. A bill dealing apparatus according to claim 3, further comprising:

means for running said bill dealing apparatus and means for drivingly controlling said running means, whereby said bill dealing apparatus is self-propelled.

5. An automatic dealing system including:

a plurality of automatic cash dealing units into which mediums to be processed may be inserted and from which said mediums may be picked up by customers or bank clerks for trading;

a programmed controller;

a plurality of processors for respectively processing said mediums under control of said programmed controller; and a movable sheet receiving apparatus for delivering said mediums between said automatic cash dealing units and said processors, wherein said movable sheet receiving apparatus comprises:

means for storing the mediums therein, means for individually feeding out and separating the mediums stacked in said storing means, means for stacking the mediums into said storing means, means for individually delivering and receiving the mediums to and from said automatic cash dealing units, means for checking the value of the mediums to be delivered and received, and means for individually transferring the mediums between said feeding and separating means, stacking means, delivering and receiving means and checking means, said transferring means including a transferring path adjacent to said delivering and receiving means, said transferring path being extensible and retractable in a medium transferring direction thereof.

* * * * *